US006467705B2

(12) United States Patent
Robidoux

(10) Patent No.: US 6,467,705 B2
(45) Date of Patent: Oct. 22, 2002

(54) TRIBO-CORONA POWDER APPLICATION GUN

(75) Inventor: Mark Alan Robidoux, Coatesville, PA (US)

(73) Assignee: The Easthill Group, Inc., Pottstown, PA (US)

( * ) Notice: Subject to any disclaimer, the term of this patent is extended or adjusted under 35 U.S.C. 154(b) by 0 days.

(21) Appl. No.: 09/771,798

(22) Filed: Jan. 29, 2001

(65) Prior Publication Data

US 2002/0100823 A1 Aug. 1, 2002

(51) Int. Cl.[7] ..... B05B 5/00; B05B 7/02; F23D 11/32; A62C 5/02

(52) U.S. Cl. ..... 239/697; 239/690; 239/690.1; 239/310; 239/525

(58) Field of Search ..... 239/697, 690, 239/690.1, 704, 705, 706, 707, 708, 310, 318, 85, 378, 372, 373, 525, 526, 527, 570, 311

(56) References Cited

U.S. PATENT DOCUMENTS

| | | | | | |
|---|---|---|---|---|---|
| 3,698,636 | A | * | 10/1972 | Szasz | 239/15 |
| 3,746,254 | A | * | 7/1973 | Duncan et al. | 239/15 |
| 4,079,894 | A | | 3/1978 | Harjar et al. | 239/526 |
| 4,143,819 | A | | 3/1979 | Hastings | 239/707 |
| 4,290,091 | A | | 9/1981 | Malcolm | 361/228 |
| 4,380,320 | A | | 4/1983 | Hollestein et al. | 239/697 |
| 4,529,131 | A | | 7/1985 | Rutz | 239/690 |
| 4,543,274 | A | | 9/1985 | Mulder | 427/197 |
| 4,580,727 | A | | 4/1986 | Moos | 239/403 |
| 4,630,777 | A | | 12/1986 | Hollstein et al. | 239/707 |
| 4,706,890 | A | | 11/1987 | Talacko | 239/692 |
| 4,747,546 | A | | 5/1988 | Talacko | 239/707 |
| 4,765,544 | A | * | 8/1988 | Kuhn et al. | 239/698 |
| 4,798,340 | A | * | 1/1989 | Vohringer et al. | 239/692 |
| 4,886,215 | A | | 12/1989 | Ruud | 239/690.1 |
| 5,044,564 | A | * | 9/1991 | Sickles | 239/690.1 |
| 5,056,720 | A | * | 10/1991 | Crum et al. | 239/698 |
| 5,395,046 | A | | 3/1995 | Knobbe et al. | 239/3 |
| 5,402,940 | A | | 4/1995 | Haller et al. | 239/697 |
| 5,622,313 | A | | 4/1997 | Lader et al. | 239/3 |
| 5,850,976 | A | * | 12/1998 | Robidoux | 239/698 |
| 6,003,779 | A | | 12/1999 | Ribidoux | 239/3 |

* cited by examiner

*Primary Examiner*—Lesley D. Morris
*Assistant Examiner*—Davis Hwu
(74) *Attorney, Agent, or Firm*—Duane Morris LLP

(57) ABSTRACT

The invention provides a gun for spraying a powder onto a work piece to form a coating and includes a pistol-grip housing having an air valve coupled to a source of pressurized air. The housing also supports a source of variable electrical potential. A powder container is disposed in fluid communication with the air valve so that powder within the container may be fluidized by air from the source of pressurized air when the valve is opened. A nozzle is positioned within the housing and includes a central passageway having an open end and disposed in fluid communication with the powder container. The central passageway frictionally imparts a net electrical charge of a first polarity to a first portion of the powder when the first portion of the powder contacts the surface during the spraying. A discrete member is positioned within the central passageway and is capable of imparting a net electrical charge of a second polarity to a second portion of the powder when the second portion of the powder contacts the tubes during the spraying. An emitter rod is positioned within the central passageway and comprises a proximal end and a distal end, where the proximal end is interconnected to the source of variable electrical potential.

11 Claims, 6 Drawing Sheets

TRIBO-CORONA POWDER APPLICATION GUN

FIELD OF THE INVENTION

The invention generally relates to powder coating application systems, and more particularly to spray guns that fluidize and deliver powder coatings to a work piece, using electrostatically charged powder.

BACKGROUND OF THE INVENTION

Electrostatic powder spray guns are known for use in applying protective coatings to industrial and commercial products. Typically, a finely divided powder is transported through a spray head while entrained in an air or gaseous stream that is discharged from the spray head. The entrained powder is directed by the spray head toward a target article or work piece and is drawn toward the article or work piece by opposite electrostatic charges (at least effectively) on the powder and on the work piece. After the work piece has been coated with the charged powder, the article is heated. The powder melts and flows together to bond and form a more permanently adhered coating as it cools.

Electrostatic powder spray guns as described are well known in the art. Examples are disclosed in U.S. Pat. No. 4,079,894—Harjar, et al.; U.S. Pat. No. 4,143,819—Hastings; U.S. Pat. No. 4,380,320—Hollstein, et al.; U.S. Pat. No. 4,529,131—Rutz; U.S. Pat. No 4,543,274—Mulder; U.S. Pat. No. 4,580,727—Moos; U.S. Pat. No. 4,630,777—Hollstein, et al.; U.S. Pat. No. 4,706,890—Talacko; U.S. Pat. No. 4,747,546—Talacko; U.S. Pat. No. 4,886,215—Ruud; U.S. Pat. No. 5,056,720—Crum, et al.; U.S. Pat. No. 5,395,046—Knobbe, et al.; U.S. Pat. No. 5,402,940—Haller, et al.; and U.S. Pat. No. 5,622,313—Lader, et al. These patents teach various apparatus, methods, and systems for the electrostatic application of powder coatings to a work piece.

Conventional electrostatic powder coating apparatus typically comprise a spray gun that charges the powder in one of two ways. In one type of device, the gun has a high voltage charging electrode which produces a corona that charges the powder as powder particles move through the corona. Voltages in the range from about 30 to about 100 kilovolts (kV) are typically applied to the electrode in this type of spray gun. Gas propellant pressures in the range of 30 to 70 pounds per square inch (psi) or more are often required as well. While such guns are suitable for many industrial applications, they can be difficult and/or expensive to operate. Additionally, the high voltages and gas pressures required for satisfactory operation make these devices potentially dangerous, particularly for casual users such as small shops and home hobbyists.

In a second type of known device, the gun charges the powder by friction, i.e., triboelectrically, the electrostatic effect produced by rubbing a nonconductive article such as an inflated rubber balloon against certain fabrics. In triboelectric electrostatic spray guns, contact surfaces along the discharge path of the spray gun are constructed from an electrically insulating material, typically a polymer. During spraying, the finely divided powder particles are caused to impact the contact surfaces numerous times and thereby become frictionally charged. High voltage is not required, but propellant gas pressures in the range of 30 to 70 psi or more are often required to produce the necessary frictional contact to effectively charge the sprayed powder.

An undesirable consequence of the triboelectric interaction between the powder and the contact surfaces of the gun is the creation of a charge on the contact surfaces that is opposite in polarity to that imparted to the powder particles. This effect reduces the efficiency of the gun, and has resulted in various attempts in the art to control or reduce the build up of charge on the gun's contact surfaces.

In U.S. Pat. No. 4,706,890—Talacko, a spray gun is disclosed which contains a discharge electrode disposed entirely outside the region where the powder flows and in electrical communication with the gas flowing in a gas conduit. The powder is accelerated, by pressurized gas, through an annularly shaped and axially extending channel in which the coating material is electrically charged by friction. The channel is defined between inner and outer members formed from different electrically insulating materials. Unwanted charge that builds up on the inner and outer members is discharged to the electrode through the flowing gas.

In U.S. Pat. No. 5,622,313—Lader, et al., a triboelectric powder spray gun is disclosed in which a charge is imparted triboelectrically to the powder by repeated impacts of the powder with internal contact surfaces formed from electrically insulating materials such as PTFE or polyamide. Lader et al., increase the charging effectiveness of their gun by using an electrode disposed within the gun barrel to produce a corona treatment of the contact surfaces to discharge the contact surfaces and eliminate the need for adjacent ground pathways within the powder flow path.

In U.S. Pat. Nos. 5,850,976 and 6,003,779, both issued to Robidoux, a spray gun for applying powder to coat a work piece uses triboelectric the properties in a plurality of tubes to charge powder particles electrostatically. The gun communicates with a source of pressurized air through a handle with an air valve controlling flow of the air. Powder in a container in fluid communication with the air flow is fluidized and entrained when the valve is opened. A nozzle with an internal surface defining a passageway to an open end communicates with the powder container. The internal surface of the nozzle frictionally imparts a net electrical charge of a first polarity to part of the powder by frictional contact during spraying. A plurality of discrete tubes are disposed in the central passageway and impart a net electrical charge of a second polarity to another part of the powder due to frictional contact as that part flows around and through the tubes. The powder then exits the nozzle and contacts the work piece. In U.S. Pat. No. 6,003,779, a perforated disk is disposed at the open end of the nozzle to provide for an even dispersal of powder on the target object to be coated. U.S. Pat. Nos. 5,850,976 and 6,003,779, are incorporated herein by reference.

SUMMARY OF THE INVENTION

The present invention provides a gun for spraying a powder onto a work piece to form a coating. In one embodiment the gun comprises a pistol-grip housing including an air valve coupled to a source of pressurized air. A powder container is disposed in fluid communication with the air valve so that powder within the container is fluidized by air from the source of pressurized air when the valve is opened. A nozzle is positioned within the housing, and includes a central passageway having an open end and which is disposed in fluid communication with the powder container. The central passageway frictionally imparts a net electrical charge of a first polarity to a first portion of the powder when the first portion of the powder contacts the surface during the spraying. A discrete member is disposed within the central passageway and is capable of imparting a net electrical charge of a second polarity to a second portion of the powder when the second portion of the powder contacts the tubes during the spraying.

In an alternative embodiment, a gun for spraying a powder onto a work piece to form a coating is provided that includes a pistol-grip housing having an air valve coupled to a source of pressurized air. The housing also supports a source of variable electrical potential. A powder container is disposed in fluid communication with the air valve so that powder within the container may be fluidized by air from the source of pressurized air when the valve is opened. A nozzle is positioned within the housing and includes a central passageway having an open end and disposed in fluid communication with the powder container. The central passageway frictionally imparts a net electrical charge of a first polarity to a first portion of the powder when the first portion of the powder contacts the surface during the spraying. A discrete member is positioned within the central passageway and is capable of imparting a net electrical charge of a second polarity to a second portion of the powder when the second portion of the powder contacts the tubes during the spraying. An emitter rod is positioned within the central passageway and comprises a proximal end and a distal end, where the proximal end is interconnected to the source of variable electrical potential.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
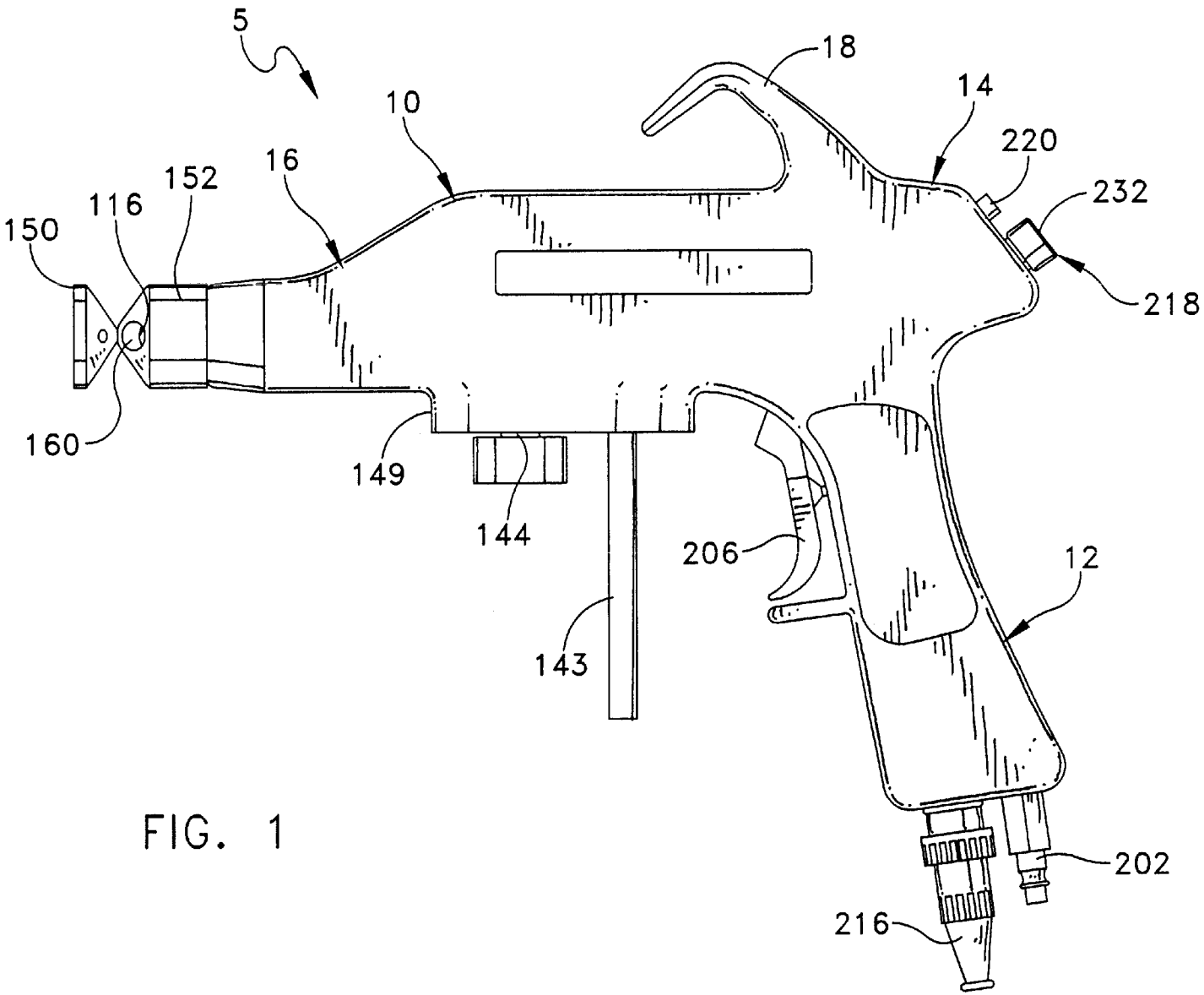
FIG. 1 is a side elevational view of a powder application gun formed in accordance with the present invention.

This description of preferred embodiments is intended to be read in connection with the accompanying drawings, which are to be considered part of the entire written description of this invention. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Figure 2:
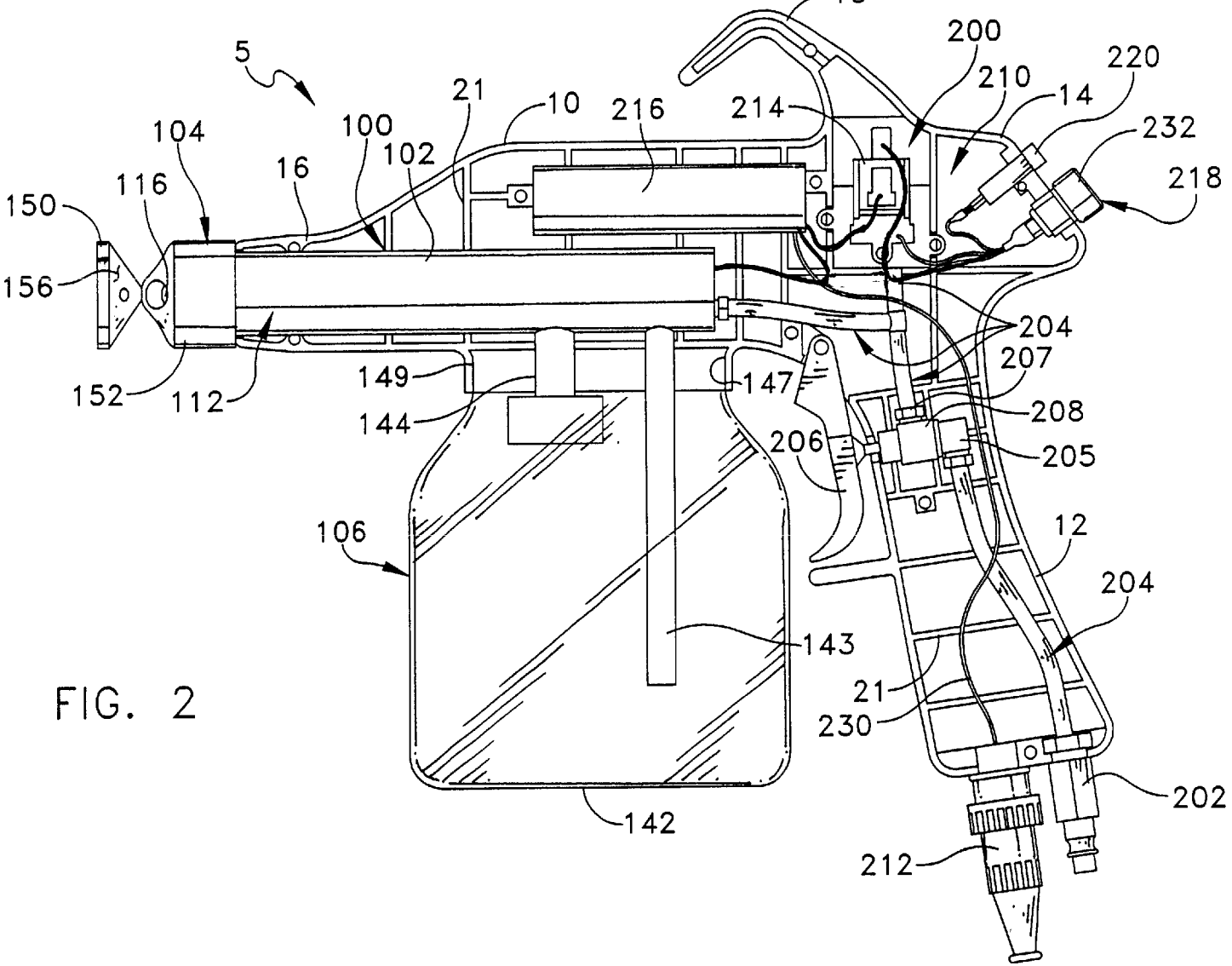
FIG. 2 is a cross-sectional view of the powder application gun shown in FIG. 1.

Referring to FIGS. 1–2, a powder application gun 5 formed according to the present invention includes a housing 10, a barrel assembly 100, and an air/electric assembly 200. More particularly, housing 10 comprises a "pistol-shaped" profile that is adapted for hand-held operation, including a hand grip 12, butt-end 14, and barrel 16. A hook 18 projects from the top surface of butt-end 14, and is provided to allow for convenient hanging storage of powder application gun 5. Housing 10 may be formed from any of the well known engineering polymer materials that are suitable for injection molding, e.g., polyhalo-olefins, polyamides, polyolefins, poly-styrenes, polyvinyls, polyacrylates, polymethacrylates, polyesters, polydienes, polyoxides, polyamides, polycarbonates, polyterephthalates, and polysulfides and their blends, copolymers and substituted derivatives.

Figure 7:
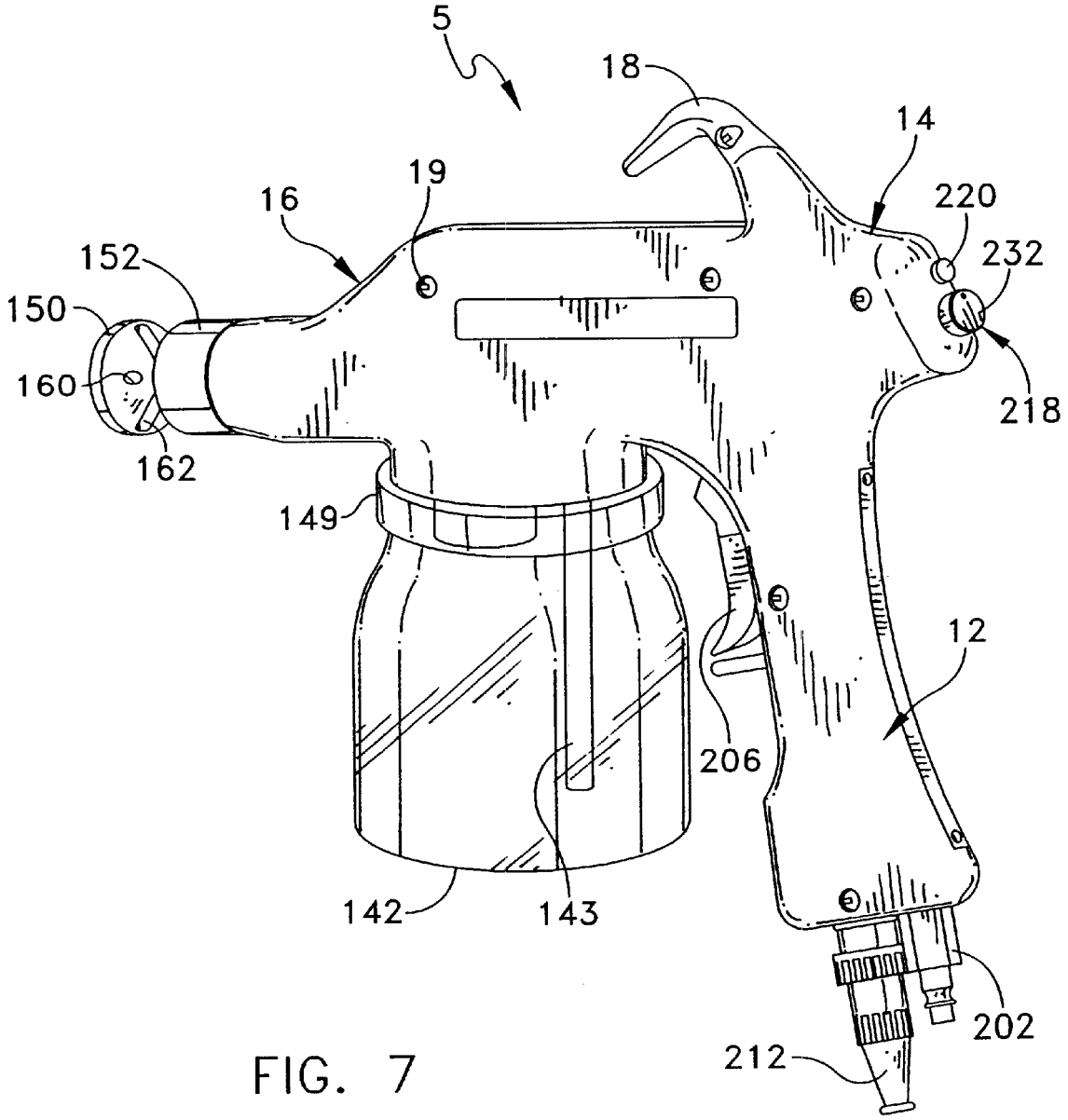
FIG. 7 is a rear perspective view of the powder application gun used for powder coating a work piece formed in accordance with the present invention.

Housing 10 is often formed in two substantially symmetric halves, which are mated and secured together, via fasteners 19 (FIG. 7), or glued or welded together in the conventional manner. A substantially hollow interior space is defined between the assembled halves of housing 10 that is sized and shaped to accept portions of barrel assembly 100 and air/electric assembly 200. Recessed support structures 21 are provided on the interior of housing 10 to support and orient the components comprising barrel assembly 100 and air/electric assembly 200, as well as to provide for better structural integrity. A plurality of openings are also formed through the walls of housing 10, when assembled, that are sized and shaped to accept portions of barrel assembly 100 and air/electric assembly 200, as will hereinafter be disclosed in further detail.

Figure 3:
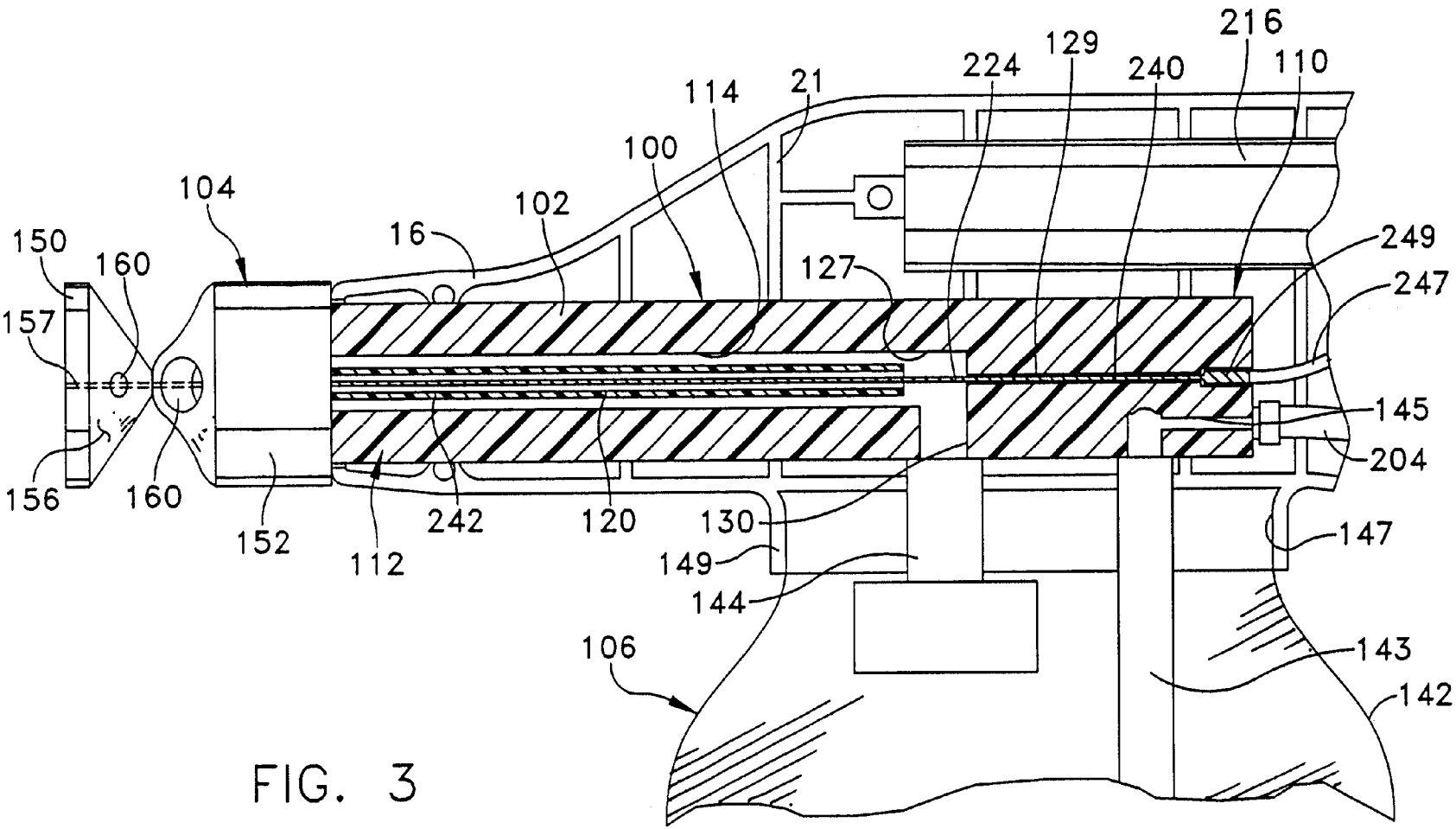
FIG. 3 is a partially broken-away side elevational view of the powder application gun shown in FIG. 2, with a portion of a barrel assembly shown in cross-section.
Figure 4:
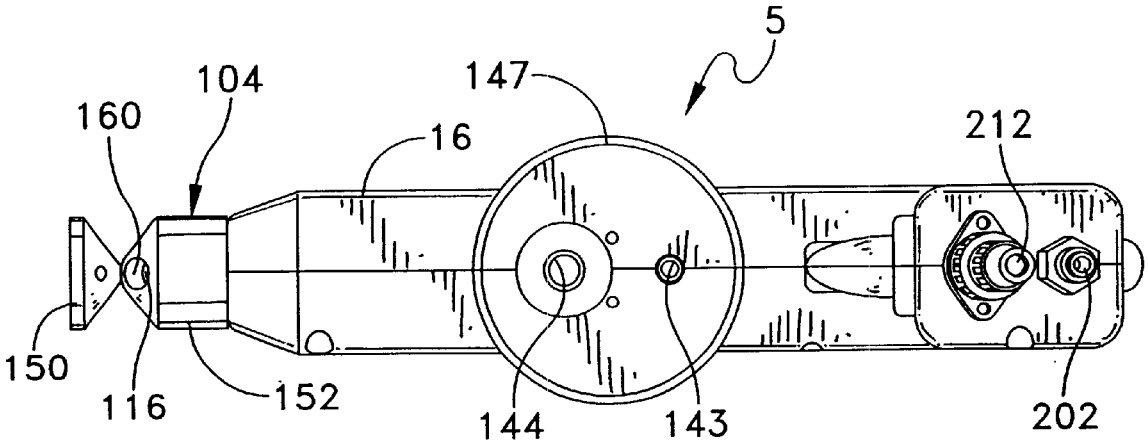
FIG. 4 is a bottom view of the powder application gun shown in FIG. 1.
Figure 5:
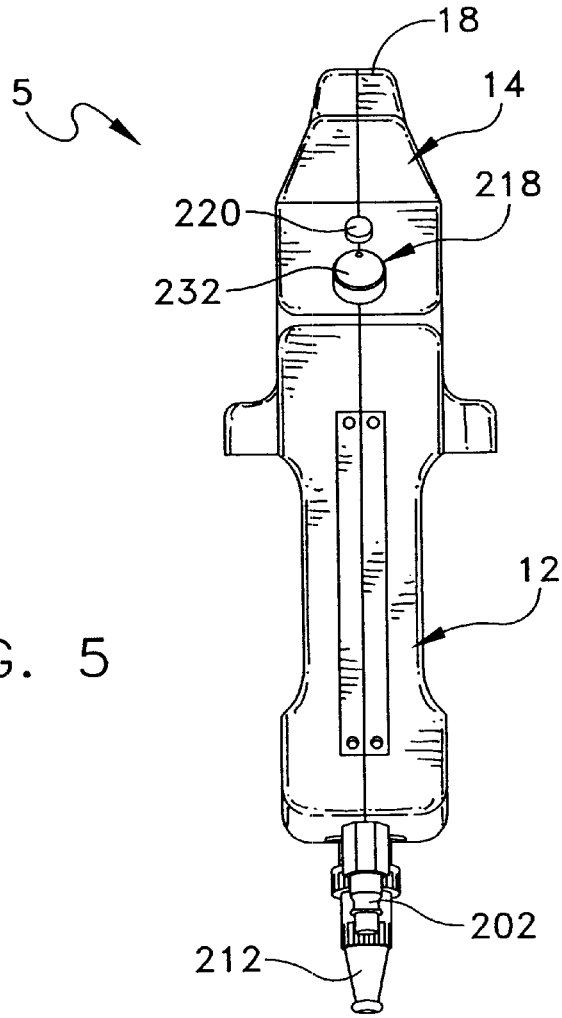
FIG. 5 is a rear view of the powder application gun shown in FIG. 1.

Referring to FIGS. 2 and 3, barrel assembly 100 comprises a nozzle 102, a deflector 104, and a powder container assembly 106. Barrel assembly 100 is formed from an electrically insulating material, e.g., polyamide (nylon) or the like. Nylon exhibits strong positive polarity triboelectric charging properties. Thus powders that exhibit a strong negative triboelectric charging tendency, e.g., PTFE, polyester, etc., can be used with barrel assembly 100 with good results. The powders are preferably thermoset or thermoplastic and after coating are melted to bond the powder coating, which can contain pigments. Nozzle 102 defines a substantially cylindrical cross-section having an outside diameter sized to fit within housing 10 and supported by recessed support structures 21. Nozzle 102 includes a proximal end 110, a distal end 112, and a central passageway 114 (FIG. 3). Central passageway 114 of nozzle 102 forms a triboelectric discharge chamber. Central passageway 114 defines an opening 116 in distal end 112 of nozzle 102.

Figure 6:
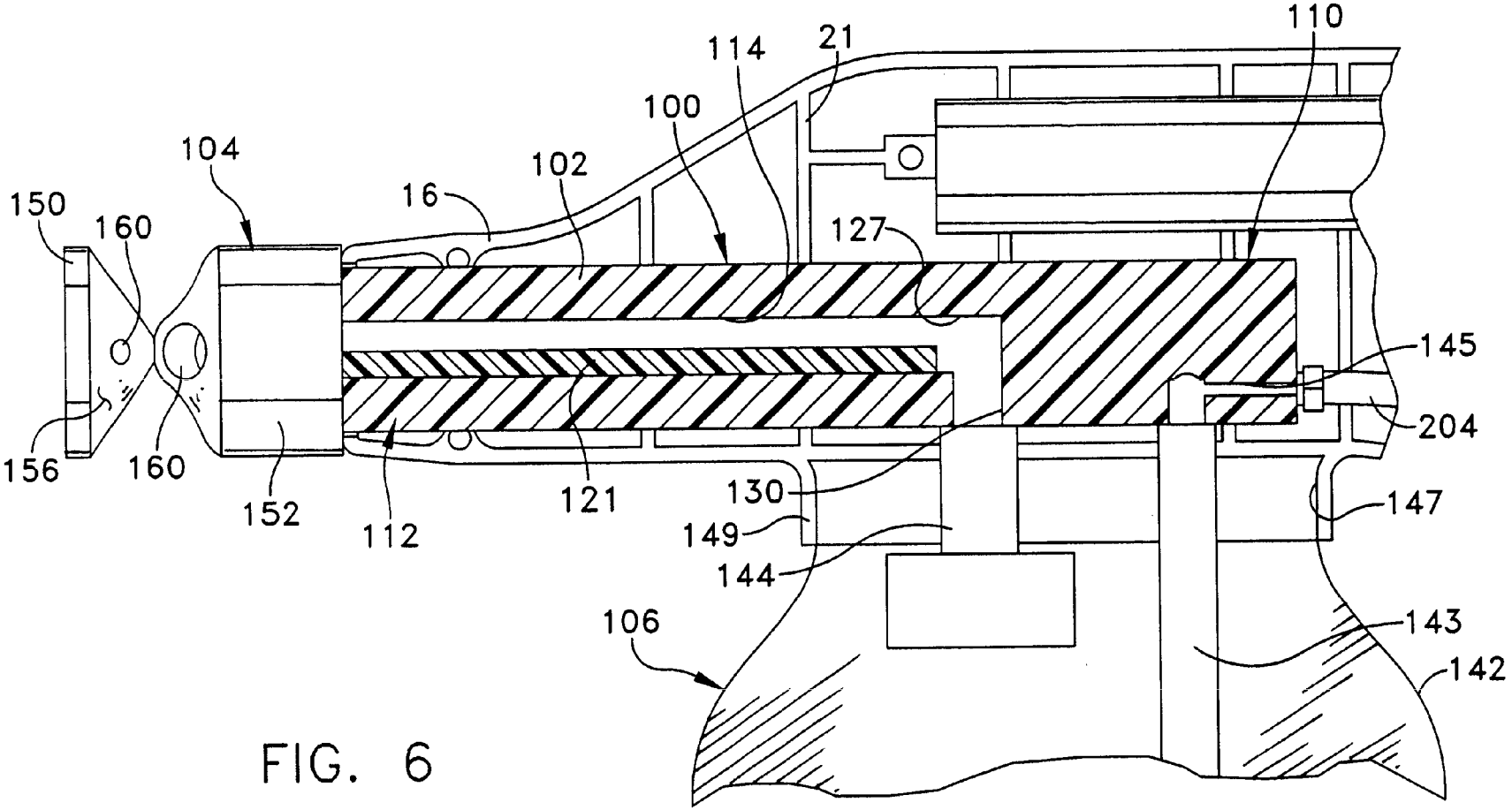
FIG. 6 is a partially broken-away side elevational view of an alternative embodiment of powder application gun, with a portion of a barrel assembly shown in cross-section and showing a cross-sectional view of a discrete member positioned within the nozzle.

One discrete member or tube 120 is positioned within central passageway 114 of nozzle 102, and preferably comprises a hollow, cylindrical cross-section, and is no more in length than central passageway 114. Discrete tube 120 preferably comprises a length and diameter that allows it to be positioned within central passageway 114 during assembly and operation of powder application gun 5. Advantageously, discrete tube 120 is separate from, and relatively loosely assembled within, central passageway 114. It will be understood that discrete tube 120 may have various cross-sectional shapes. While not preferred, the discrete tube may also comprise a solid or semi-solid rod 121 (FIG. 6) that is either loosely positioned within nozzle 102, or engaged with an interior wall of nozzle 102. Discrete tube 120 or solid or semi-solid rod 121 can be formed from an electrically insulating material, such as polytetrafluoroethylene (PTFE) or the like, which exhibits strong negative-polarity triboelectric charging properties, i.e., opposite to the positive polarity of the nylon of nozzle 102, and may be interchangeable. Powders that exhibit a strong positive triboelectric charging tendency, e.g., nylon, some epoxy materials, etc., can also be used with the invention with good results. A transfer section 127 is integral with proximal end 110 of nozzle 102, and has a substantially cylindrical cross-section. Transfer section 127 includes a first passageway 129 that extends through proximal end 110 to communicate with a portion of air/electric assembly 200 and a second passageway 130 that opens into powder container assembly 106 that projects downwardly from proximal end 110 of nozzle 102 and the underside of barrel 16 (FIGS. 2 and 3).

Powder container assembly 106 comprises a cup 142, a fluidizing tube 143, and a discharge tube 144. Cup 142 comprises a substantially cylindrical container having a threaded open end 147. The underside of barrel 16 includes an annular, threaded flange 149 that is adapted to mate with threaded open end 147 of cup 142. Fluidizing tube 143 is fastened in proximal end 110 of nozzle 102, and communicates, via passageway 145, with a portion of air/electric assembly 200. Discharge tube 144 is fastened in proximal end 110 of nozzle 102, and communicates with second passageway 130 of nozzle 102. In this way, pressurized air is delivered to the interior of cup 142, via fluidizing tube 143, so as to fluidize coating powder particles within cup 142. The fluidized coating powder from cup 142 is then delivered to central passageway 114 of nozzle 102, via discharge tube 144 and transfer section 127. Cup 142 is sized to receive approximately one pound of finely divided coating powder.

Deflector 104 is removably fastened to distal end 112 of nozzle 102, and preferably comprises a conical disk 150 and a sleeve 152. Deflector 104 is formed from one or more polymers of the type disclosed hereinabove. Conical disk 150 includes deflecting surface 156 and a central, electrode bore 157. Preferably, deflector 104 further comprises a plurality of spray bores 160 and slots 162 (FIG. 7) defined through deflecting surface 156. A central electrode bore 157 is formed through the apex of conical disk 150, and is sized to accept a portion of air/electrical assembly 200. Sleeve 152 is cylindrically shaped with a central recess that has a diameter that is slightly larger than the diameter of nozzle 102 at distal end 112. In this way, sleeve 152 can be slid over distal end 112 of nozzle 102.

Deflecting surface 156 is arranged to cause charged and air entrained coating powder to deflect radially outwardly relative to nozzle 102, during operation of powder application gun 5. Spray bores 160 and slots 162 are defined in deflecting surface 156, through deflector 104, and are circumferentially arranged. Spray bores 160 preferably comprise a circular shape and slots 162 preferably comprise an elongated oval shape, although other shapes (oval, square, parallelogram, multi-sided, etc.) may also be employed with equal effect. It will be understood that deflector 104 may have any number of spray bores 160 and slots 162 consistent with its structural integrity. Spray bores 160 and slots 162 provide for a more uniform application of powder during the spraying operation, especially when powder application gun 5 is used to coat large surfaces. Spray bores 160 and slots 162 also enhance the efficiency of powder application gun 5.

Referring to FIGS. 2 and 3, air/electric assembly 200 includes an air coupler 202, a plurality of air tubes 204, a trigger 206, an air valve 208, and an adjustable voltage, electric discharge system 210. More particularly, air coupler 202 is located in an opening in the bottom of hand grip 12, and provides for interconnection with a source of pressurized gas, e.g., relatively dry and clean compressed air or the like, by means of a flexible hose (not shown). An air tube 204, e.g., a nylon tube, leads from air coupler 202 to an entrance orifice 205 in air valve 208 so as to place air coupler 202 and air valve 208 in flow communication. Trigger 206 is pivotally mounted on a side surface of hand grip 12, and is arranged to operatively engage and selectively actuate, i.e., open and close, air valve 208 by simply squeezing trigger 206 toward hand grip 12, and then releasing it. Air valve 208 is suitable for use with air supply pressures in a range from about five to about twelve psi. A second tube 204 extends from an exit orifice 207 of air valve 208 and is coupled to passageway 145 in proximal end 110 of nozzle 102. In this way, air valve 208 is operatively interconnected, in flow communication with fluidizing tube 143 and powder container assembly 140.

Adjustable voltage electric discharge system 210 includes a jack 212, a pressure/electric switch 214, a power supply 216, an adjustable rotary potentiometer 218, a voltage indicator 220, and an emitter rod 224. More particularly, jack 212 is located in an opening in the bottom of hand grip 12 adjacent to air coupler 202, and provides for operative interconnection to a source of electrical power. For example, a conventional DIN receptacle interconnection device has been found to provide adequate results when used in one embodiment of the present invention.

A cable 230 interconnects jack 212 to power supply 216. Power supply 216 may be an inverter capable of supplying a predetermined DC electrical potential in the range from about 10 kV to about 25 kV, or more, as required for the particular coating operation. Suitable high voltage, low current power supplies capable of supplying an electrical potential in this range are known in the art. Pressure/electric switch 214 is operatively interconnected between power supply 216 and air valve 208 so that when air valve 208 is opened a portion of the stream of pressurized air is diverted (via tube 204) to engage pressure/electric switch 214 so as to actuate the switch.

Adjustable rotary potentiometer 218 is electrically interconnected to power supply 216, via pressure/electric switch 214, and is positioned in an opening in butt-end 14 so that a rotatable dial 232 is accessible for hand adjustment. In this way, a continuous range of voltages may be selected from power supply 216 by rotating dial 232. Indicator 220 is also electrically interconnected to adjustable potentiometer 218 so that the operator of powder application gun 5 may see a visual display and indication of the voltage being applied from power supply 216 to emitter rod 224. Adjustable rotary potentiometer 218 and voltage indicator 220 are of the type well known in the art.

Emitter rod 224 comprises a proximal end 240 and a distal end 242, and is typically formed from 304L stainless steel or the like. Proximal end 240 extends through passageway 129 of nozzle 102 so that emitter rod 224 is positioned in coaxial-relation with central passageway 114 of nozzle 102 and within discrete tube 120. An insulated cable 247 is electrically interconnected to an interface hub 249 located on proximal end 240 of emitter rod 224 and to adjustable power supply 216. Emitter rod 224 extends throughout the length of nozzle 102, with distal end 242 projecting outwardly from nozzle 102 and through electrode bore 157 of deflector 104.

Powder application gun 5 is operated as follows. Air coupler 202 is interconnected to a source of pressurized air in the range from about five to about twelve psi. Air valve 208 is opened, by actuating trigger 206 producing a flow of pressurized air through tubes 204 to passageway 145 and fluidizing tube 143, and to pressure/electric switch 214. The air flow fluidizes the powder into a turbulent cloud of particles in cup 142. A portion of the fluidized powder is forced through discharge tube 144 and into transfer section 127. The fluidized powder travels through transfer section 127 and enters central passageway 114 of nozzle 102. Once within central passageway 114 of nozzle 102, a portion of the fluidized powder interacts with the inner surface of nozzle 102, becoming frictionally charged through the triboelectric effect. At the same time, another portion of the fluidized powder flows through and around discrete tube 120 where that portion of the fluidized powder is also charged by the triboelectric effect.

Advantageously, powders comprising a tendency to triboelectrically charge either negatively or positively may be used with the present invention, since contact surfaces having a tendency to charge powder negatively (PTFE) and contact surfaces having a tendency to charge powder positively (nylon) are present. It will also be understood that powder exiting nozzle 102 may be either positively or negatively charged as a result of its transit through central passageway 114 of nozzle 102. Of course, nozzle 102 may be formed from PTFE or the like and discrete tube 120 may be formed from nylon or the like. Also, while PTFE and nylon are preferred materials for nozzle 102 and discrete tube 120, other materials having similar triboelectric properties may also be substituted without deviating from the present invention.

The powder flows through nozzle 102 and through and around discrete tube 120 and then exits nozzle 102, via spray bores 160 and slots 162 in deflector 104. The finely divided powder is triboelectrically charged during its transit through central passageway 114 of nozzle 102 and also given a variable charging boost, via a corona discharge from emitter rod 224. More particularly, as the powder traverses central passageway 114 it comes into contact with the surface of emitter 224 and is further charged by the corona discharge created by emitter rod 224. Advantageously, the intensity of the corona discharge may be continuously varied as a result of rotating dial 232 of adjustable rotary potentiometer 218. The invention has been found to provide effective powder coating of an intricately shaped work piece when emitter rod 224 is energized in the range from about 10 kV to about 25 kV.

The need for discharging a build up of charge on the contact surfaces of powder application gun 5 is greatly reduced or eliminated by placing discrete tube 120 or discrete member 121 within central passageway 114 of nozzle 102. Powder application gun 5 can be used without the application of electric potential or corona discharge. However, a variable corona discharge from emitter 224 provides an added electrical charge to the powder particles as they transit the gun toward the work piece. This promotes increased powder transfer efficiency (i.e., the ratio of powder sprayed verses the powder adhered to workpiece).

It is to be understood that the present invention is by no means limited only to the particular constructions herein disclosed and shown in the drawings, but also comprises any modifications or equivalents within the scope of the claims.

What is claimed is:

1. A gun for spraying a powder onto a work piece to form a coating, said gun comprising:

a pistol-grip housing including an air valve coupleable to a source of pressurized air, and supporting a source of variable electrical potential comprising a power supply operatively interconnected between a pressure/electric switch and an adjustable potentiometer wherein said pressure/electric switch is operatively interconnected to and activated by said source of pressurized air and said adjustable potentiometer is interconnected to a voltage indicator having a display positioned on an outer surface of said pistol-grip housing;

a powder container disposed in fluid communication with said air valve wherein said powder is fluidized by air from said source of pressurized air when said valve is opened;

a nozzle having a central passageway including an open end and disposed in fluid communication with said powder container, said central passageway frictionally imparting a net electrical charge of a first polarity to a first portion of said powder when said first portion of said powder contacts said surface during said spraying;

a discrete member disposed within said central passageway and capable of imparting a net electrical charge of a second polarity to a second portion of said powder when said second portion of said powder contacts said tubes during said spraying; and an emitter rod positioned within said central passageway and comprising a proximal end and a distal end wherein said proximal end is interconnected to said source of variable electrical potential.

2. Apparatus according to claim 1 wherein said power supply comprises an inverter capable of supplying a predetermined DC electrical potential in the range from about 10 kV to about 25 kV.

3. Apparatus according to claim 1 wherein said pressure/electric switch is operatively interconnected between said power supply and said air valve so that when said air valve is opened a portion of a stream of pressurized air is diverted to engage and actuate said pressure/electric switch.

4. Apparatus according to claim 1 wherein said emitter rod extends through central passageway and within said discrete tube.

5. Apparatus according to claim 1 wherein said air valve is interconnected to said source of pressurized air through an air coupler and is actuated by a trigger mounted to said pistol-grip housing.

6. Apparatus according to claim 5 wherein a tube extends from an exit orifice of said air valve and is operatively coupled to said proximal end of said nozzle and to a pressure/electric switch mounted within said pistol-grip housing and operatively interconnected said power supply so that when said air valve is opened a portion of a stream of pressurized air is diverted to engage and actuate said pressure/electric switch.

7. A gun for spraying a powder onto a work piece to form a coating, said gun comprising:

a pistol-grip housing including a trigger actuated air valve coupled to a source of pressurized air and supporting a power supply that is operatively interconnected between said pressure activated switch and an adjustable potentiometer wherein said pressure activated switch is operatively interconnected to and activated by said source of pressurized air and said adjustable potentiometer is interconnected to a voltage indicator having a display positioned on an outer surface of said pistol-grip housing;

a powder container disposed in fluid communication with said trigger actuated air valve wherein said powder is fluidized by air from said source of pressurized air when said valve is actuated;

a nozzle having a first end through which said fluidized powder is introduced into a central passageway and a second end through which said fluidized powder emerges, said central passageway having at least one charging surface therein made of a first electrically insulated material suitable for electrically charging said powder by friction;

a discrete tube disposed within said central passageway, separate from said central passageway, said tube having at least one charging surface thereon made of a second electrically insulated material suitable for electrically charging said powder by friction; and, a corona discharge assembly including an emitter rod positioned in substantially coaxial relation to said central passageway, a power supply positioned within said pistol-grip housing, a pressure activated switch operatively interconnected between said power supply and said trigger actuated air valve, a variable potentiometer positioned in said housing, and said emitter rod.

8. Apparatus according to claim 7 wherein said power supply comprises an inverter capable of supplying a predetermined DC electrical potential in the range from about 10 kV to about 25 kV.

9. Apparatus according to claim 7 wherein said pressure/electric switch is operatively interconnected between said power supply and said air valve so that when said air valve is opened a portion of a stream of pressurized air is diverted to engage and actuate said pressure/electric switch.

10. Apparatus according to claim 7 wherein said emitter rod extends through central passageway and within said discrete tube.

11. Apparatus according to claim 7 wherein a tube extends from an exit orifice of said air valve and is operatively coupled to said proximal end of said nozzle and to a pressure/electric switch mounted within said pistol-grip housing and operatively interconnected said power supply so that when said air valve is opened a portion of a stream of pressurized air is diverted to engage and actuate said pressure/electric switch.

* * * * *